US005716555A

United States Patent [19]

Mullican et al.

[11] Patent Number: 5,716,555

[45] Date of Patent: Feb. 10, 1998

[54] MULTI-FUEL EXTERNAL METERING ROD AND SYSTEM

[75] Inventors: Vernon T. Mullican, Fresno; Edwin G. Mulligan, Tulare, both of Calif.

[73] Assignee: Concerned Shareholders, Visalia, Calif.

[21] Appl. No.: 719,332

[22] Filed: Sep. 25, 1996

[51] Int. Cl.[6] ..... F02M 11/08

[52] U.S. Cl. ..... 261/41.4; 261/44.7; 261/50.1; 251/206; 137/270

[58] Field of Search ..... 261/44.7, 50.1, 261/41.4, 44.3, 44.2; 251/206; 137/270

[56] References Cited

U.S. PATENT DOCUMENTS

| | | | |
|---|---|---|---|
| 674,034 | 5/1901 | Krastin | 261/41.4 |
| 1,616,726 | 2/1927 | Wilcox | 261/41.4 |
| 2,709,579 | 5/1955 | Sykes . | |
| 2,836,198 | 5/1958 | McNeill | 251/206 |
| 3,752,451 | 8/1973 | Kendig . | |
| 3,931,368 | 1/1976 | Barker . | |
| 4,021,512 | 5/1977 | Kaufman | 261/44.2 |
| 4,056,583 | 11/1977 | Shinoda et al. | 261/44.7 |
| 4,065,106 | 12/1977 | Althausen | 251/206 |
| 4,123,479 | 10/1978 | Andreassen | 261/44.3 |
| 4,268,462 | 5/1981 | Ota . | |
| 4,280,969 | 7/1981 | Swanson . | |
| 4,283,355 | 8/1981 | Herd . | |
| 4,446,887 | 5/1984 | Redmon et al. | 251/206 |
| 4,901,976 | 2/1990 | Smith | 251/206 |
| 5,126,079 | 6/1992 | Nagamatsu . | |

FOREIGN PATENT DOCUMENTS

| | | | |
|---|---|---|---|
| 1152718 | 9/1957 | France | 251/206 |

*Primary Examiner*—Tim R. Miles
*Attorney, Agent, or Firm*—Mark D. Miller

[57] ABSTRACT

Disclosed is an adjustable apparatus for regulating the flow of fuel into a carburetor by use of a specially designed fuel metering rod. The hollow rod includes four different sets of holes along its sides at one end, each set separated from the adjacent sets by ninety degrees (90°). The holes of each set are graduated from large to small, and each set covers a different range of hole sizes. The rod slides into a housing on the side of the carburetor, the holes regulating the amount of filtered fuel delivered to the carburetor. By sliding the rod, different sized holes on the rod line up with the exit opening in the housing to the carburetor. Sliding the rod also moves a linkage which causes the opening or closing of the air valves of the carburetor. The rod may be removed and rotated (either 90°, 180° or 270°) to allow a different set of holes to line up with the exit opening to the carburetor.

2 Claims, 5 Drawing Sheets

MULTI-FUEL EXTERNAL METERING ROD AND SYSTEM

BACKGROUND OF THE INVENTION

1. Field of the Invention

The present invention relates to automobile carburetors, and, and more particularly to the improvement of a new multi-fuel external metering rod and apparatus for an automobile carburetor.

2. Description of the Prior Art

Automobile carburetors are generally well known in the art. The following U.S. Patents are known to exist:

| Patent No. | Inventor. | Issue Date |
|---|---|---|
| 2,709,579 | Sykes | May 31, 1955 |
| 3,752,451 | Kendig | August 14, 1973 |
| 3,931,368 | Barker, et al | January 6, 1976 |
| 4,268,462 | Ota, et al | May 19, 1981 |
| 4,280,969 | Swanson | July 28, 1981 |
| 4,283,555 | Herd, Jr. et al | August 11, 1981 |
| 5,126,079 | Nagamatsu | June 30, 1992 |

Changing the jets on ordinary carburetors involves removing, opening up and taking apart the carburetor assembly, which can be a messy and time consuming process. It is therefore desirable to have a carburetor assembly that is easily cleaned without requiring removal from the vehicle engine.

Carburetors also have a tendency to build up an retain heat which can affect their performance. It is therefore desirable to have a carburetor assembly that does not retain and which readily dissipates heat. Better performance and acceleration are always desirable features in automobile carburetors.

SUMMARY OF THE INVENTION

The present invention provides a new, efficient and easily adjustable apparatus for regulating the flow of fuel into a carburetor by use of a specially designed fuel metering rod. The fuel metering rod includes a hollow open-ended tube having at least one but no more than four different sets of holes along its sides at one end. Each set of holes is in a longitudinal line along one side of the tube, and is separated ninety degrees (90°, or one quarter of the tube) from adjacent sets of holes. Thus, the four sets of holes are located axially on the tube at 0°, 90°, 180° and 270°, respectively. The holes of each set are graduated from large to small, and each set covers a different range of hole sizes.

The fuel metering rod also includes an attachment or extension at its opposite end having four longitudinal slits located therein. The inside of the tube is blocked between the two ends, or at the extension. The slits allow the rod to receive a linkage member which is attached to the air valves of the carburetor. The metering rod is slidably mounted in a housing on the side of the carburetor. The housing allows the open end of the rod to be in communication with the flow of filtered fuel from the fuel line. The housing also includes a side exit opening leading to the nozzle bar of the carburetor. The metering rod is slidably placed in the housing such that one of the sets of longitudinal holes is against the exit opening leading to the nozzle bar. By sliding the rod, different sized holes in this set line up with the exit opening. Sliding the rod also causes the linkage to open or close the air valves to the carburetor. The rod may be removed and rotated (either 90°, 180° or 270°) to allow a different set of holes to line up with the exit opening in the housing.

In operation, filtered fuel enters the housing into the open end of the metering rod. The fuel passes through the rod into one of the sets of holes in the side of the rod that is adjacent to the exit opening in the housing leading to the nozzle bar. The blockage in the middle of the rod prevents fuel from leaking out the opposite end or extension. Fuel then passes through one (or more) of the holes in the set into the exit opening and on to the nozzle bar of the carburetor. Sliding the metering rod allows more or less fuel to be introduced to the nozzle bar, while at the same time causing a corresponding adjustment in the air valves of the carburetor thereby continuously accommodating an appropriate mix of air with changing quantity of fuel.

Generally speaking, the larger openings in the metering rod are located nearest to the open end. In the rest position, a biasing spring pulls the rod forward in the housing so that the smallest holes are adjacent the exit opening. As the rod is pulled out by operation of the throttle, the larger holes line up with the exit opening, and the air valves are opened up to provide more air with the increasing volume of fuel. Release of the throttle causes the spring to pull the rod back to the forward part of the housing.

The four different sets of holes in the metering rod allow for different variations in fuel introduction to the carburetor. For example, one set of holes may begin very large but decrease to very small, while another set may begin just as large but decrease to only slightly smaller. In another example, a set of holes may begin only slightly large and decrease to very little, while another set of holes may be all the same size or even increase in size.

Because of its removability, the metering rod can be quickly and easily cleaned. In addition, it makes it easier to blow out the fuel line for cleaning. The carburetor body to which the metering rod housing is attached is made of thinner aluminum so that it does not build up or retain as much heat as ordinary carburetors using heavier metals. The air valves of the present invention may be made of carbon material which also avoids heat retention. In addition, the carburetor body of the present invention is designed so that it may be glued to a carbon base plate thereby eliminating the need for a bottom gasket.

It is therefore a primary object of the present invention to provide a slidable metering rod for a carburetor that allows quick adjustment of the amount of fuel and air introduced to the carburetor.

It is a further important object of the present invention to provide a removable hollow slidable fuel metering rod having at least one set of longitudinal openings of graduated sizes along one side for controlling the quantity of fuel introduced to a carburetor.

It is a further important object of the present invention to provide a removable adjustable hollow fuel metering rod having no more than four different sets of longitudinal openings along the sides thereof such that any one of said sets of openings may be adjustably selected and used to control the quantity of fuel introduced to a carburetor.

It is another object of the invention to provide an adjustable fuel metering rod for a carburetor having a linkage to the air valves of the carburetor such that as the metering rod changes quantity of fuel introduced to the carburetor the linkage provides a corresponding change to the quantity of air introduced.

It is another object of the invention to provide an easily removable and rotatable carburetor fuel metering rod having no more than four different sets of longitudinal openings along the sides thereof such that any one of said sets of openings may be adjustably selected and used to control the quantity of fuel introduced to a carburetor.

It is another object of the present invention to provide a carburetor assembly having a removable metering rod that is easily cleaned, and which allows easy blow out of the fuel lines.

Other objects of the invention will be apparent from the detailed descriptions and the claims herein.

DETAILED DESCRIPTION OF THE DRAWINGS

Figure 1A:
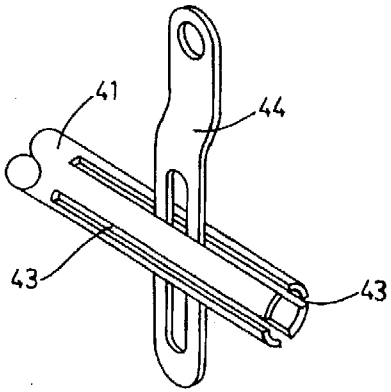
FIG. 1A is a perspective view of the air valve control linkage of the metering rod.
Figure 1:
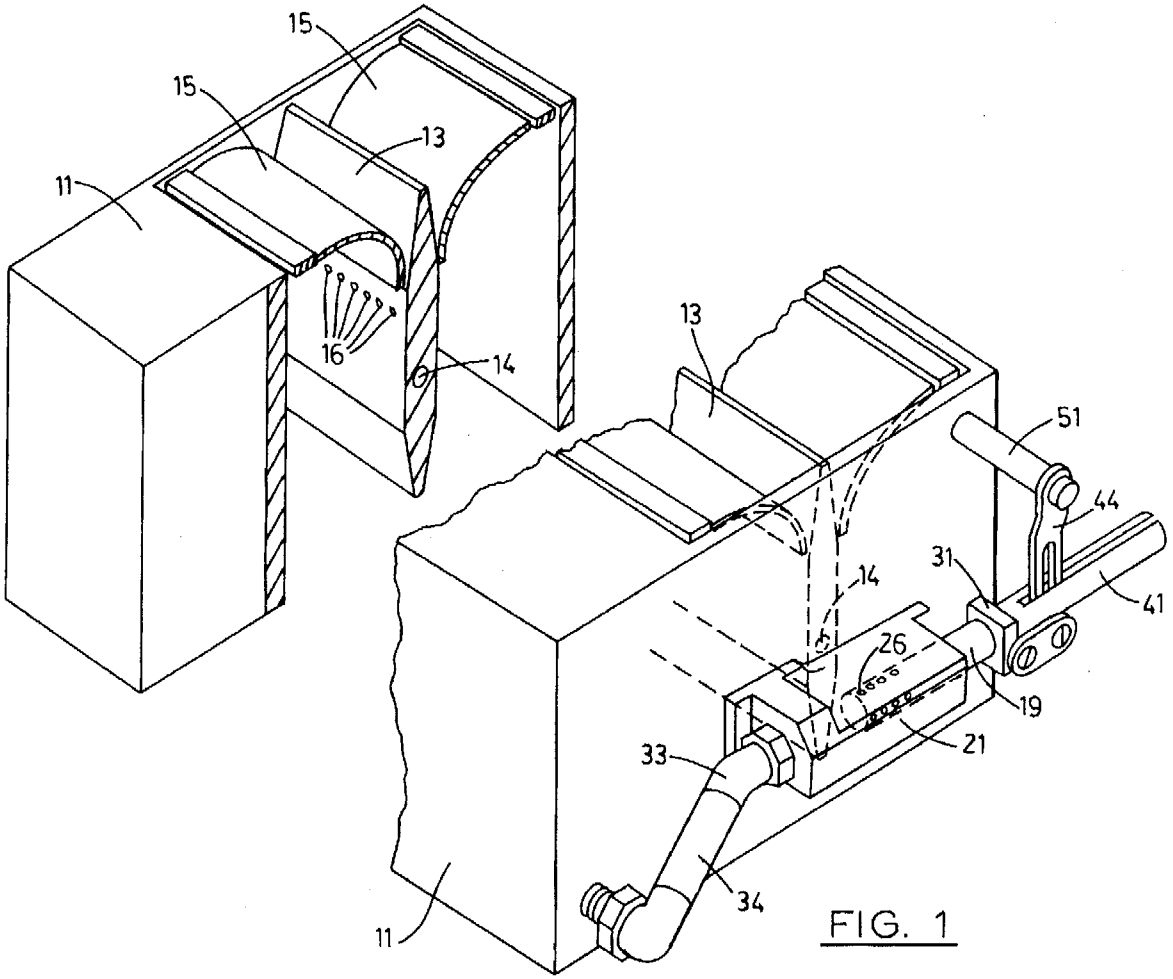
FIG. 1 is a perspective and partially cut-away side view of the present invention.
Figures 2, 2A:
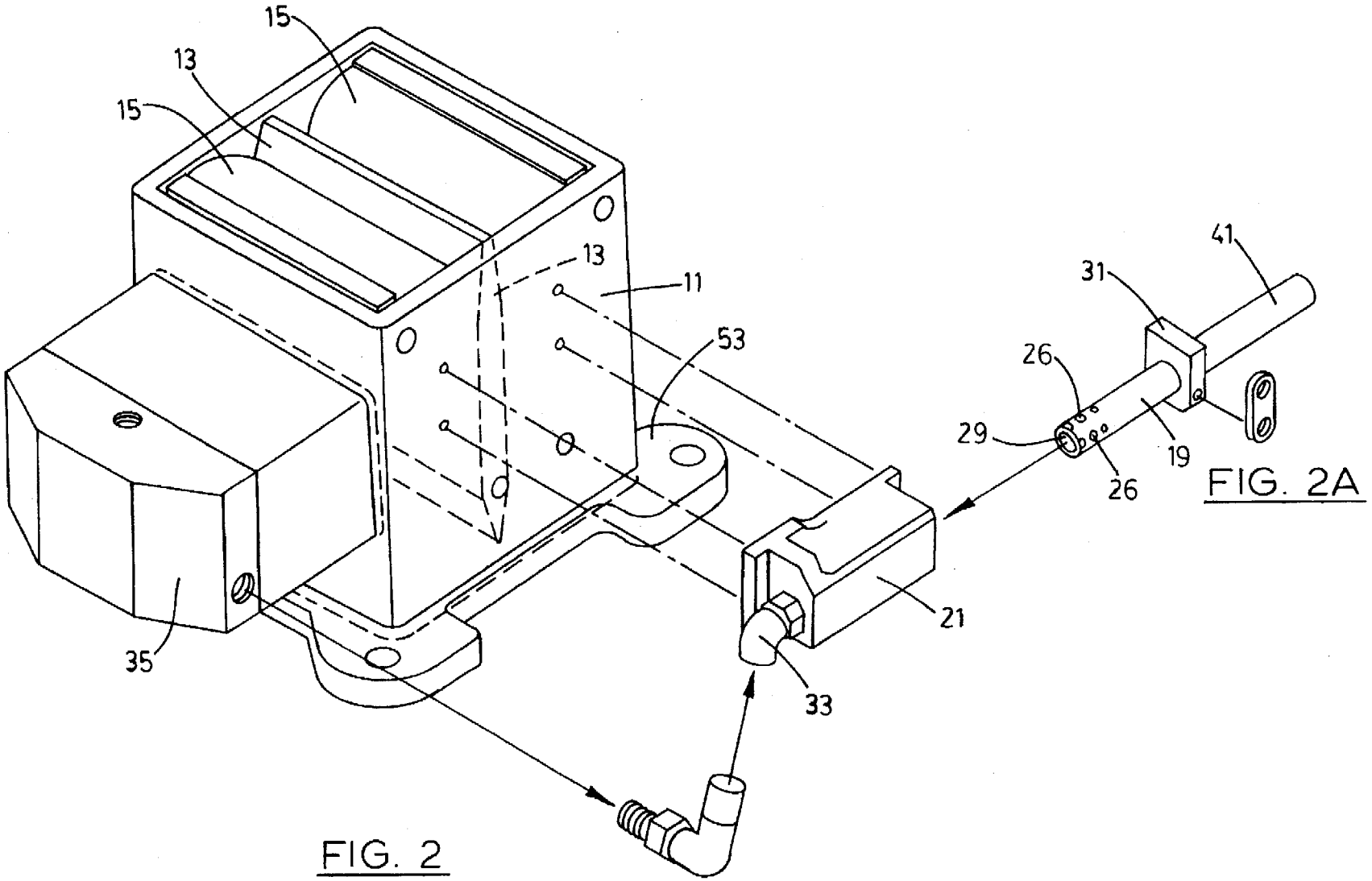
FIG. 2 is a partially exploded perspective side view of the present invention.
FIG. 2A is an alternative embodiment of the metering rod and linkage attachment.
Figure 3:
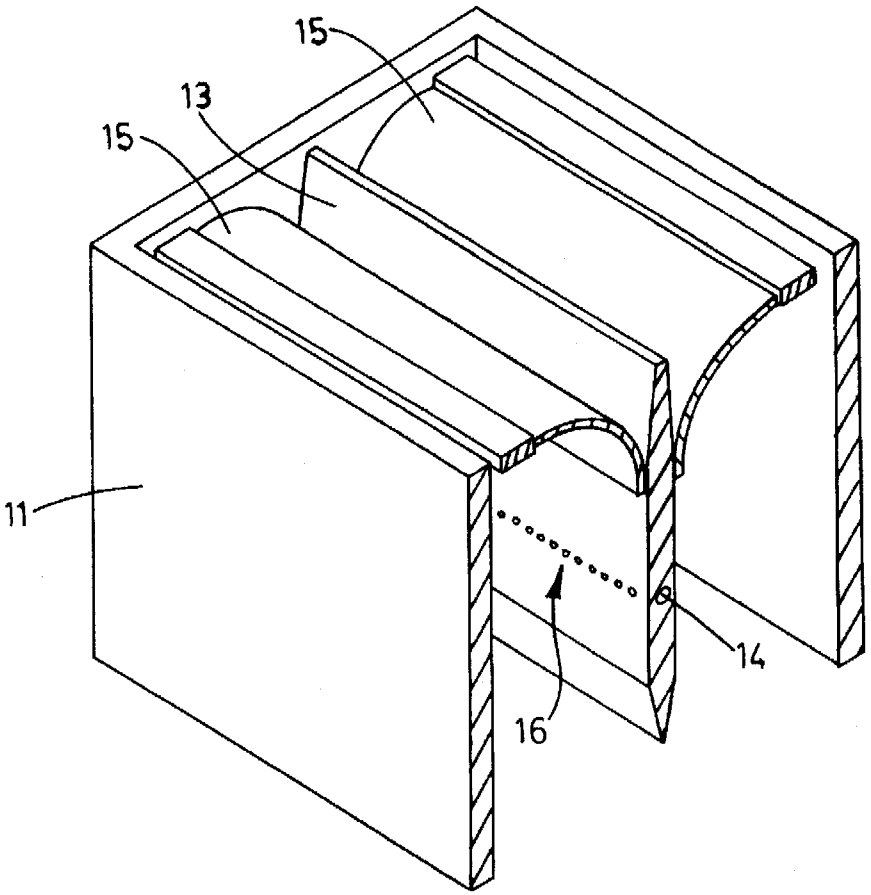
FIG. 3 is a cut-away perspective view of the carburetor nozzle bar and air valves.
Figure 4:
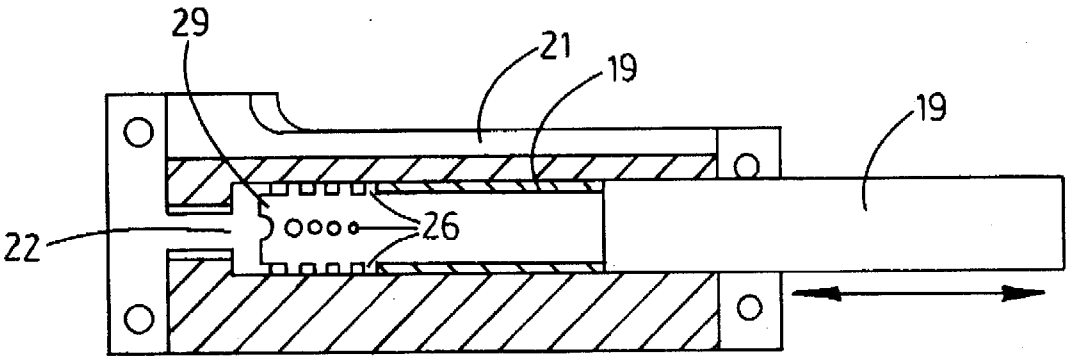
FIG. 4 is a partially cut away side view of the housing for the metering rod, showing the metering rod in place.
Figure 5:
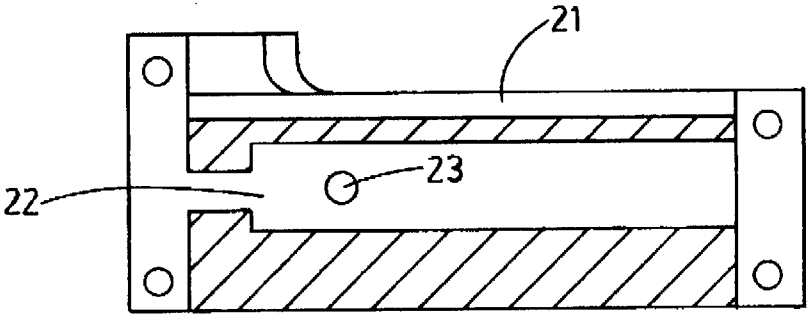
FIG. 5 is a cut-away side view of the housing for the metering rod.

Referring to the drawings wherein like reference characters designate like or corresponding parts throughout the several views, and referring particularly to FIGS. 1, 2 and 4 it is seen that the invention includes a carburetor block 11 including a nozzle bar 13 and arcuate air valves 15. Block 11 is designed to be glued to a carbon base 53. A housing 21 is attached to the outside of block 11. Housing 21 has an inlet pipe 33 which communicates through a fuel line 34 to filtered fuel from the fuel bowl (or other appropriate source) 35.

Housing 21 includes a bore 22 that is open at both ends and which includes an exit opening 23 in the side thereof. Opening 23 communicates through the side of block 11 to a corresponding opening 14 on nozzle bar 13. The opening 14 in the nozzle bar, in turn, communicates to a series of smaller openings 16 on either side of nozzle bar 13 inside the carburetor.

A hollow metering rod 19 is provided which slides in bore 22 of housing 21. At one end of rod 19 at least one, but no more than four sets of graduated openings 26 are provided. Each set of openings 26 is on a longitudinal line along rod 19, and each set is separated from the adjacent sets by ninety degrees (90°) (see FIGS. 2A and 4). One of the sets of openings 26 lines up with opening 23 in the side of bore 22. This permits fuel to enter the open end of rod 19 and exit through one of openings 26 into opening 23. By sliding rod 19 back and forth, different openings 26 line up with exit opening 23.

Each set of openings 26 in rod 19 should be of graduated sizes, with the larger openings closer to the open end 29 of rod 19 (see FIG. 4). Each set of openings 26 need not contain the same number of openings. One set may have four openings, an adjacent may have set five, and yet another set may have seven. The sizes of the openings may vary very little from beginning to end, or they may have wide ranges of variation. Rod 19 may be removed and rotated a multiple of ninety degrees in order to allow a different set of openings 26 to communicate with exit opening 23. In this way, a single rod 19 may be used for up to four different graduated ranges of fuel delivery to the carburetor.

A block (or connector) 31 is provided on rod 19 at the end opposite the sets of openings. Block 31 prevents fuel from exiting through the opposite end of rod 19. On the opposite side of block 31 an adaptor rod 41 is provided which has four longitudinal slits 43 located thereon (see FIG. 1A). The slits allow rod 41 to receive a linkage 44 which is attached to member 51 leading to the vehicle throttle 55 (not shown) and the carburetor air valves 15. Should rod 19 be removed and rotated a multiple of ninety degrees, the linkage 44 may be removed and replaced in the appropriate slits 43 for the new rotation.

Operation of the throttle rotates member 51 causing linkage 44 to pull rods 41 and 19 out from housing 21. This has the effect of moving different holes 26 to line up with exit opening 23 on the carburetor. At the same time, member 51 also causes air valves 15 to open and close as it rotates, thereby providing an increased amount of air when larger holes 26 (delivering more fuel) line up with exit opening 23. A retraction spring 49 (not shown) attached between block 31 and housing 21, or between linkage 44 and housing 21, urges rod 19 back into bore 22 of housing 21 when pressure from the throttle is released.

In operation, filtered fuel is delivered from fuel bowl 35 through pipes 33 and 34 to bore 22 in housing 21. The fuel enters rod 19 at its open top, and block 31 at the other end of rod 19 prevents the fuel from escaping that way. The fuel then passes through one or more of openings 26 in rod 19 leading through exit opening 23 and into opening 14 of nozzle bar 13 where it escapes to mix with air through openings 16. The operation of throttle 55 causes member 51 to rotate thereby moving linkage 44 and causing rod 19 to slide in bore 22 of housing 21. This sliding action causes different holes of set 26 to line up with exit opening 23 thereby changing the amount of fuel delivered based on the sizes of the holes 26. Operation of the throttle also causes air valves 15 to open or close to accommodate the changes in the amount of fuel delivered.

In an alternative embodiment shown in FIG. 2A linkage 44 attaches directly to block 31 instead of through slits 43 as shown in FIG. 1A.

Figure 6:
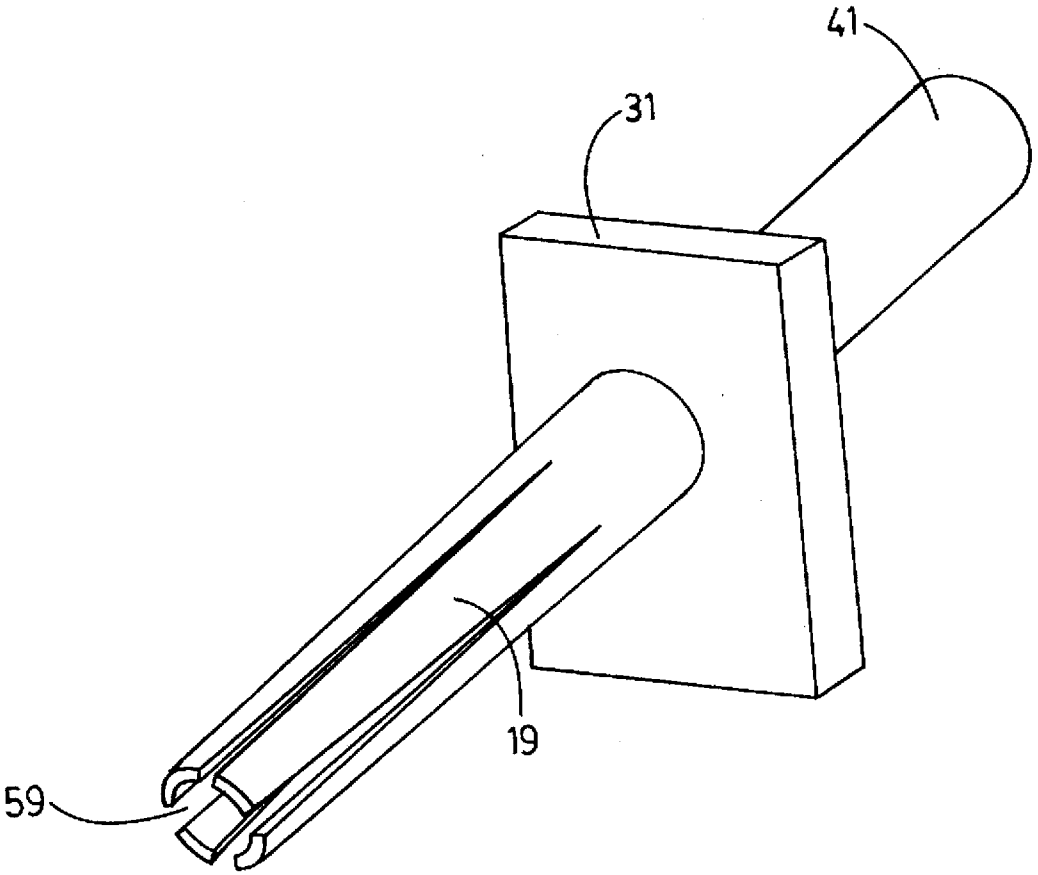
FIG. 6 is a perspective view of an alternative embodiment of the metering rod using V-shaped longitudinal openings.

In another alternative embodiment (FIG. 6) the sets of holes 26 in rod 19 may be replaced by V-shaped slits 59, the wide end of such slits being at the open end 19 tapering to the closed ends down the length of rod 19.

DESCRIPTION OF THE PREFERRED EMBODIMENTS

In the preferred embodiment, the metering rod 19 of the present invention is made of copper or other suitable non-corrosive metal. The sizes of the openings may vary very little from beginning to end, or they may have wide ranges of variation. For example, the openings in a given set of five openings 26 on the metering rod 19 may range in diameter from between 0.30 inches at the large end to 0.055 at the small end; while another set of seven openings on the same rod 19 may range in diameter from 0.25 to 0.020.

The outside diameter of rod 19 should be just slightly less than the inside diameter of bore 22 in order to allow for smooth and controlled operation and to avoid spillage of fuel. Block 11 should be made of aluminum, and may be thinner than ordinary carburetors to resist retaining heat. Air valves 15 may be made of carbon material also to resist retaining heat. Block 11 is designed so that it may be glued to base 53 to avoid the use of a gasket.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

We claim:

1. An improvement for metering fuel to an automobile carburetor comprising:

a. a housing attached to the outside of an automobile carburetor, said housing including a longitudinal bore and an opening in the side wall of said bore for communication to the inside of said carburetor;

b. a slidable hollow fuel metering rod provided in said bore, said metering rod having an open end and an opposite closed end and multiple sets of longitudinal openings of progressive size at the open end;

c. a linkage attached to said rod connected back to the throttle of said carburetor;

d. a means for supplying filtered fuel to the bore of said housing; and e. means to selectively position the metering rod so that alternate sets of the longitudinal openings are in alignment with said opening in the sidewall of said bore.

2. An improvement for metering fuel to an automobile carburetor comprising:

a. a housing attached to the outside of an automobile carburetor, said housing including a longitudinal bore and an opening in the side wall of said bore for communication to the inside of said carburetor;

b. a slidable hollow fuel metering rod provided in said bore, said metering rod having an open end and an opposite closed end;

c. multiple longitudinal V-shaped openings on said rod, each such opening defining a wide gap at the open end of said rod which tapers to a close down the length of said rod;

d. a linkage attached to said rod connected back to the throttle of said carburetor;

e. a means for supplying filtered fuel to the bore of said housing; and f. means to selectively position the metering rod so that an alternate V-shaped longitudinal opening is in alignment with said opening in the sidewall of said bore.

* * * * *